US007775272B2

(12) United States Patent
Nelson et al.

(10) Patent No.: US 7,775,272 B2
(45) Date of Patent: Aug. 17, 2010

(54) PASSIVE CENTRALIZER

(75) Inventors: Keith Nelson, Sugar Land, TX (US); Franz Aguirre, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/686,063

(22) Filed: Mar. 14, 2007

(65) Prior Publication Data

US 2008/0223573 A1 Sep. 18, 2008

(51) Int. Cl.
*E21B 17/10* (2006.01)

(52) U.S. Cl. ..... 166/241.6; 166/241.1; 166/213

(58) Field of Classification Search ..... 166/250.01, 166/382, 213, 214, 242.1, 242.6
See application file for complete search history.

(56) References Cited

U.S. PATENT DOCUMENTS

| | | | | |
|---|---|---|---|---|
| 2,841,226 | A * | 7/1958 | Conrad et al. | 166/213 |
| 3,915,229 | A * | 10/1975 | Nicolas | 166/241.5 |
| 4,557,327 | A * | 12/1985 | Kinley et al. | 166/241.5 |
| 4,776,397 | A * | 10/1988 | Akkerman | 166/241.5 |
| 5,005,642 | A | 4/1991 | Moore | |
| 5,358,039 | A * | 10/1994 | Fordham | 166/241.1 |
| 6,655,460 | B2 * | 12/2003 | Bailey et al. | 166/301 |
| 6,799,634 | B2 * | 10/2004 | Hartog et al. | 166/250.12 |
| 6,871,706 | B2 | 3/2005 | Hennessey | |
| 6,910,533 | B2 * | 6/2005 | Guerrero | 166/206 |
| 6,920,936 | B2 * | 7/2005 | Sheiretov et al. | 166/382 |
| 7,048,064 | B1 * | 5/2006 | Smith | 166/382 |
| 7,090,007 | B2 * | 8/2006 | Stuart-Bruges et al. | 166/241.5 |
| 7,096,939 | B2 | 8/2006 | Kirk | |
| 7,096,940 | B2 | 8/2006 | Baxter | |
| 7,140,431 | B2 | 11/2006 | Betts | |
| 7,159,668 | B2 | 1/2007 | Herrera | |
| 7,334,642 | B2 * | 2/2008 | Doering et al. | 166/382 |
| 2002/0112853 | A1 | 8/2002 | Buytaert | |
| 2003/0150611 | A1 | 8/2003 | Buytaert | |
| 2004/0256113 | A1 * | 12/2004 | LoGiudice et al. | 166/381 |
| 2007/0181298 | A1 * | 8/2007 | Sheiretov et al. | 166/212 |

* cited by examiner

*Primary Examiner*—David J Bagnell
*Assistant Examiner*—David Andrews
(74) *Attorney, Agent, or Firm*—Michael L. Flynn; David Hofman; Jody Lynn DeStefani

(57) ABSTRACT

A passive centralizer for stably centering within a well. The centralizer may be of a retracted profile for advancement within the well and deployable for centralization upon reaching an operation site. Deployment may be achieved in an automated manner without the requirement of operator interaction therefor. Furthermore, the centralizer may be truly passive in that energy for deployment may be stored entirely within the passive centralizer prior to its insertion within the well. The passive centralizer may also be compressed following centralization by any number of downhole restrictions. In this manner the passive centralizer may also be readily withdrawn from the well.

18 Claims, 8 Drawing Sheets

PASSIVE CENTRALIZER

FIELD OF THE INVENTION

Embodiments described herein relate to centralizers. Passive centralizers are primarily discussed. In particular, embodiments of passive centralizers that employ automated retention, deployment and locking mechanisms are described in detail.

BACKGROUND OF THE RELATED ART

Centralizers are often employed in oilfield and related industries where controlled positioning of a device within a well may be of importance. For example, in the case of a hydrocarbon well there may arise the need to deliver a downhole tool several thousand feet down into the well for performance of an operation thereat. In performing the operation it may be preferable that the tool arrive at the operation site in a circumferentially centered manner (with respect to the diameter of the well). Therefore, a centralizer may be associated with the downhole tool in order to ensure its circumferentially centered delivery to the operation site. This may be especially beneficial where the well is of a horizontal or other configuration presenting a challenge to unaided centralization.

A centralizer may include radially disposed arms biased outwardly from a mandrel or other supporting body in order to contact sides of the well wall, thus, centrally positioning the supporting body. A downhole tool such as that described above may be coupled to the supporting body and thereby circumferentially centered at the operation site. This manner of centralization may be advantageous for a host of different types of operations. In fact, in many operations the vertical alignment of multiple separately delivered downhole tools may be beneficial. In this manner centralization of such tools at an operation site provides a known orientation or positioning of the tools relative to one another. This known orientation may be taken advantage of where the tools are to interact during the course of the operation, for example where one downhole tool may be employed to grab onto and fish out another. Additionally, a host of other operations may benefit from the circumferentially centered positioning of a single downhole tool. Such operations may relate to drilling performance, oil well construction, and the collection of logging information, to name a few.

Unfortunately, the delivery of a downhole tool through the use of a centralizer is prone to inflict damage at the wall of the well by the radially disposed arms of the centralizer. This is because the centralizer is configured with arms reaching an outer diameter capable of stably supporting itself within wider sections of the well. For example, the centralizer may reach a natural outer diameter of about 13 inches for stable positioning within a 12 inch diameter section of a well. However, the centralizer is generally a passive device with arms of a single size that are biased between the support body and the well wall. Therefore, as the diameter of the well becomes smaller the described arms, often of a bow spring configuration, are forced to deform and compress to a smaller diameter as well. For example, the same 12 inch diameter well may become about 3 inches in diameter at some point deeper within the well. This results in a significant amount of compressive force to distribute between the arms and the wall of the narrowing well. That is, as the bowed arms become forced down to a lower profile by the narrowing well wall, more force is exerted thereby on the well wall.

The above described exertion of force can become quite extreme depending on the configuration and dimensions of the arms and the extent of the well's narrowing. As a result, such bow spring arms may prematurely wear out or cause significant damage to the well wall as the centralizer is forced through narrower well sections. This is unfortunate considering that many of these narrower well sections may have no relation to the actual operation site. Thus, the indicated damage may occur in sections of the well where centralization by the centralizer is unnecessary. Furthermore, due to the forces between the centralizer and the well wall, a significant amount of additional force, for example, through coiled tubing advancement, may be required. This may leave coiled tubing, the centralizer, and even the well itself susceptible to damage from application of such greater forces thereupon.

As an alternative to passive centralizers described above, active centralizers such as tractoring mechanisms or other devices capable of interactive or dynamic arm diameter changes may be employed. However, these types of devices are fairly sophisticated and generally require the exercise of operator control over the centralizer's profile throughout the advancement or withdrawal of the device from the well. Thus, such mechanisms are prone to operator error which may lead to well damage exceeding that possible from the above described passive centralizer. Furthermore, rather than reliance on the radially extending natural force of a bowing or similar arm, such devices may require the maintenance of power to the arms at all times in order to attain biasing against the well wall with the arms. Therefore, unlike a passive centralizer, the active centralizer may fail to centralize when faced with a loss of power.

SUMMARY

A passive centralizer is provided with an arm coupled to a support body. The arm may be retained against the support body by a retention mechanism. Further, a deployment mechanism may be coupled to the retention mechanism for disengagement thereof. In this manner the arm may be allowed to radially expand away from the support body.

In another embodiment, the passive centralizer may include a support body with a radially biased arm for compressing and expanding relative to the support body. A locking mechanism may be coupled to the arm and body to eliminate the expanding once a predetermined degree of compressing has occurred.

DETAILED DESCRIPTION

Embodiments are described with reference to certain passive centralizers for use in underground wells. Focus is drawn to passive centralizers of a bow spring configuration. However, a variety of other centralizer types may be employed. Regardless, embodiments described herein include a truly passive centralizer that may be deployed for use and subsequently locked in a compressed position all based on downhole conditions and well features encountered by the centralizer.

Figure 1:
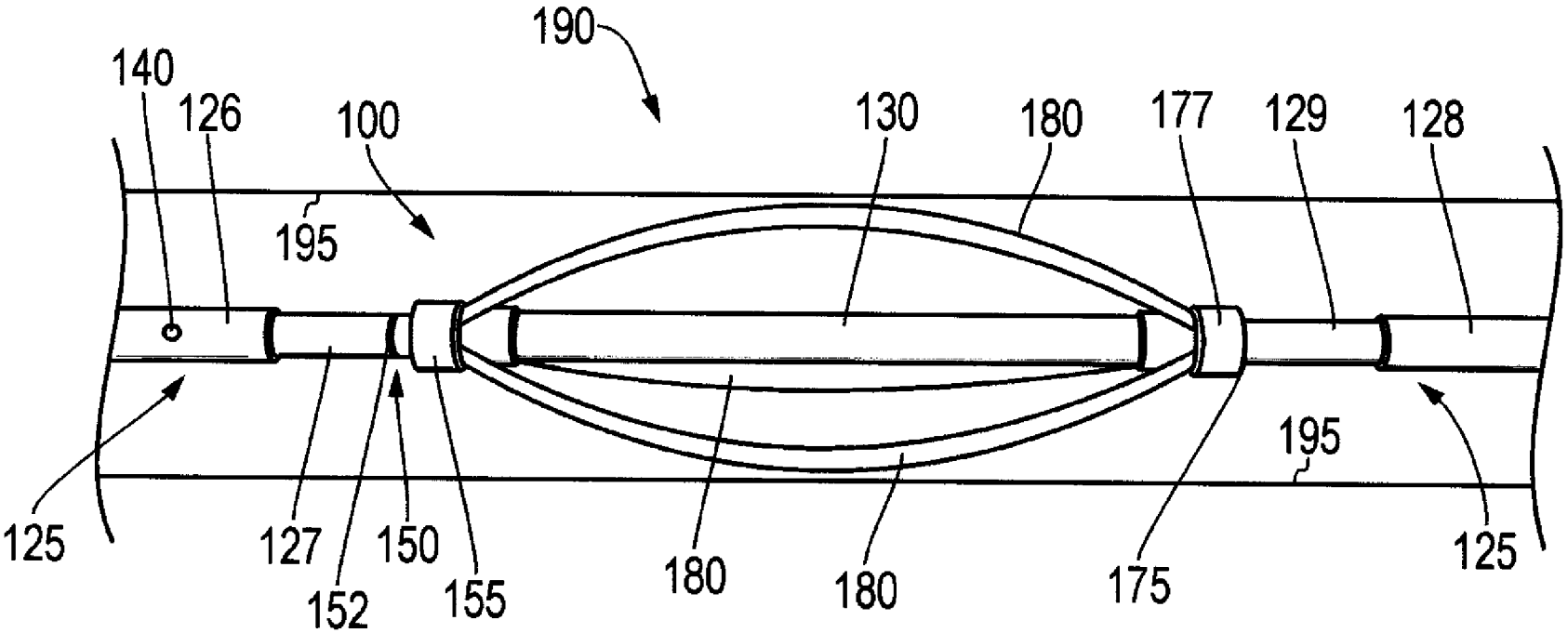
FIG. 1 is a side perspective view of an embodiment of a passive centralizer disposed within a well.

Referring now to FIG. 1, an embodiment of a passive centralizer 100 is shown disposed within a well 190. The passive centralizer 100 is depicted in a deployed or expanded position at the site of an operation. As detailed herein the passive centralizer 100 is configured such that deployment may be avoided until the centralizer 100 reaches a depth in the well 190 where centralization is desired, such a depth may be referred to as an operation site.

Centralized operations at an operation site within a well may include fishing, drilling, milling, underreaming, cutting, well construction, and logging, to name a few. Due to the avoidance of deployment in advance of positioning of the centralizer 100 at the operation site, undue scratching, shearing or other mechanical damage to the well wall 195 as well as damage to the passive centralizer 100 itself may be minimized during advancement to the operation site, which may be accomplished for example by a conventional coiled tubing application.

The passive centralizer 100 of FIG. 1 includes a support body 125 that is centered within the well 190 due to the operation of radially deployed arms 180 which are outwardly biased to force against the well wall 195 and centralize the support body 125. In the embodiment shown, the arms 180 are made up of bow springs that have been deployed from a retracted position (see FIG. 2 where the bow springs are flattened from their naturally bowed position and thus are loaded with stored energy) to an expanded position (see FIG. 1 where the bow springs are expanded into contact with a well wall 195). Upon deployment toward the well wall 195, the arms 180 are able to take on the more natural bow-shape inherent to their original construction.

Figure 8:
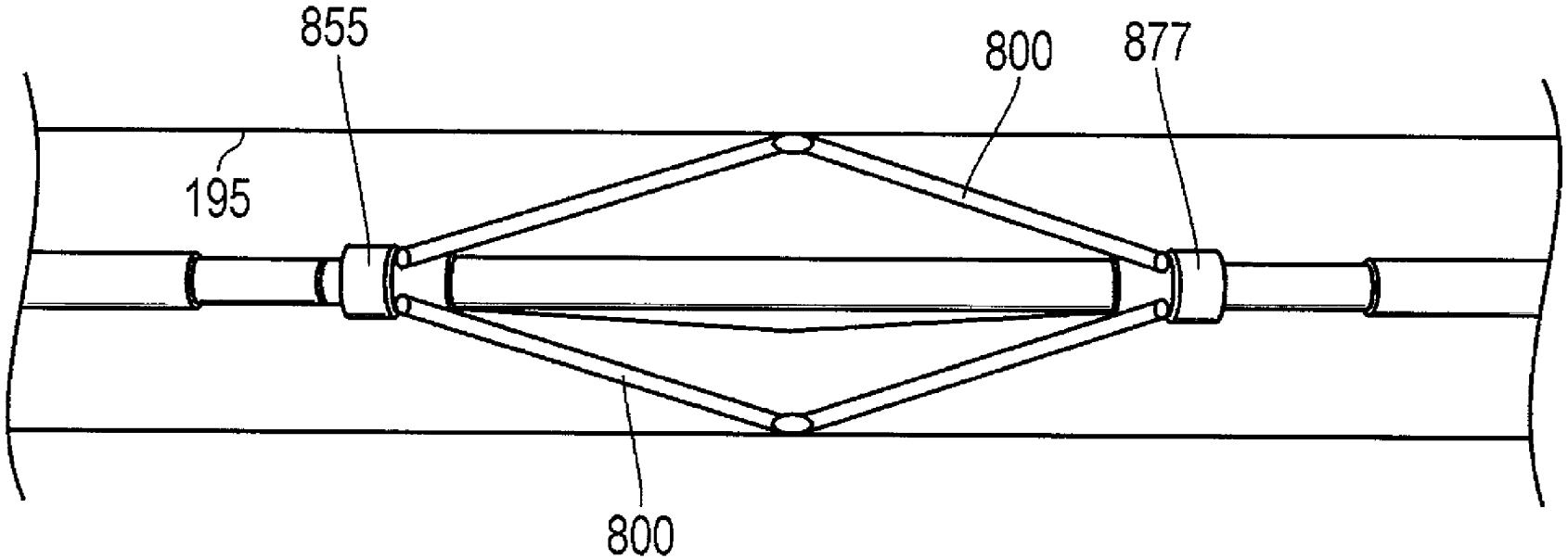
FIG. 8 is a side perspective view of an alternate embodiment of a passive centralizer disposed within the well of FIG. 1.

While bow-shaped arms 180 are shown, a variety of other deployable arms may be employed for the biasing and centering of the passive centralizer 100 as shown. For example, projectable arms 880 may be provided with spring biased collars 855, 877 for spring loaded deployment of the arms 880 toward the well wall 195 (see FIG. 8). Regardless, as described further herein, the arms 180 are configured to move from a retracted position to an expanded position of deployment as a result of the release of energy stored at the arms 180 as opposed to moving due to the supply of energy thereto for expansion. In this manner, the passive centralizer 100 provides centralization in a truly passive manner rather than by employing motors or other powering mechanisms by surface control.

Note that, as shown in FIG. 1, the centralizer 100 includes a plurality of arms 180. In alternative embodiments the centralizer may include any appropriate number of arms 180 such as, two, three, four, or five, or more. In addition, the arms 180 are preferably equally spaced about a circumference of the support body 125, although other configurations may be practiced as well.

Figure 3:
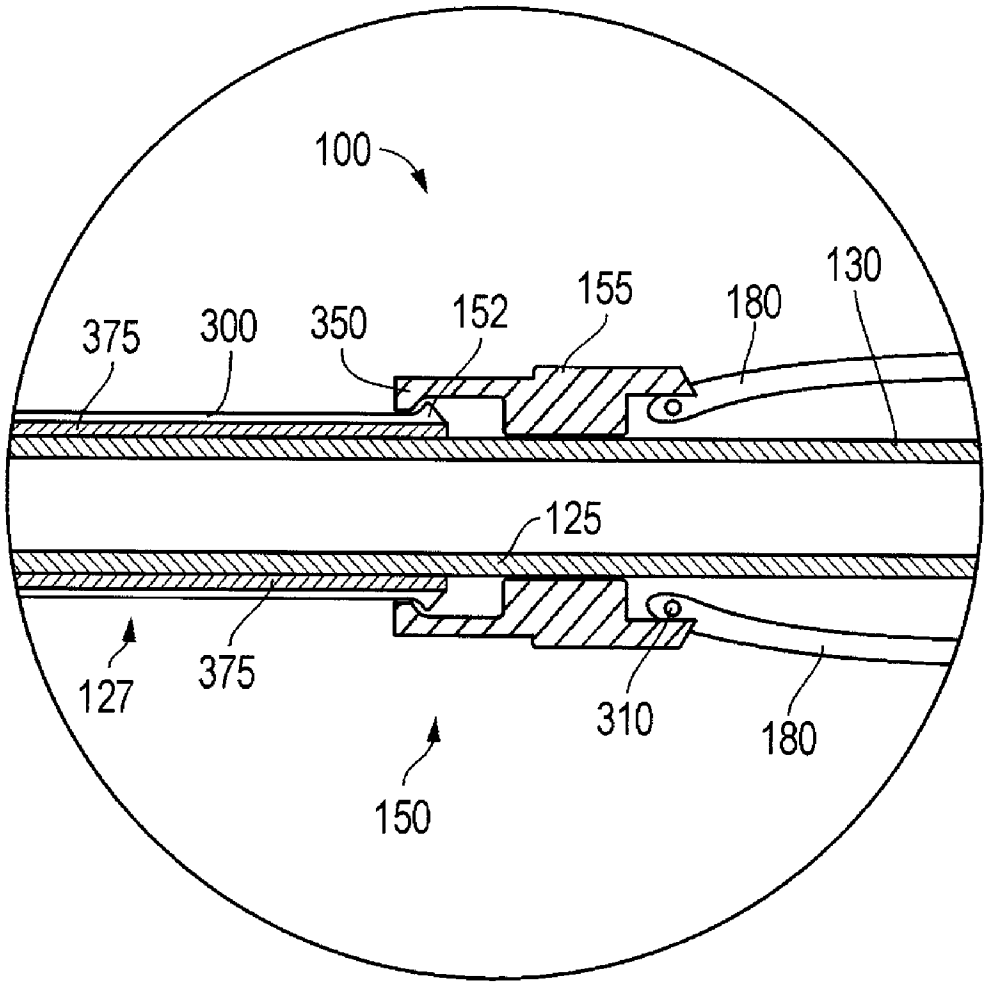
FIG. 3 is a side cross-sectional view of retention and deployment mechanisms of the passive centralizer of FIGS. 1 and 2.

As shown in FIGS. 1 and 3, the passive centralizer 100 includes a deployment site 150 where retention and deployment mechanisms are located. The retention mechanism may include a deployment collar 155 coupled to the arms 180 and the support body 125. The deployment collar 155 is immobilized when the retention and deployment mechanisms are engaged, but when the retention and deployment mechanisms are disengaged, the deployment collar 155 is laterally mobile relative to the support body 125 to deploy the arms 180 as described further herein. As described below, in one embodiment the engagement of the retention and deployment mechanisms is achieved by retention implements 152 which engage the deployment collar 155. The deployment collar 155 may be released from the retention implements 152 by a movement of the deployment mechanism. For example, in the depicted embodiment, the deployment mechanism is a retractable platform sleeve 375 which is positioned below the retention impediments 152, such that a movement of the retractable sleeve 375 away from the retention implements 152 causes the retention implements 152 to move inwardly toward the support body 125 and out of contact with the deployment collar 155 (see FIGS. 3 and 4).

Figure 5:
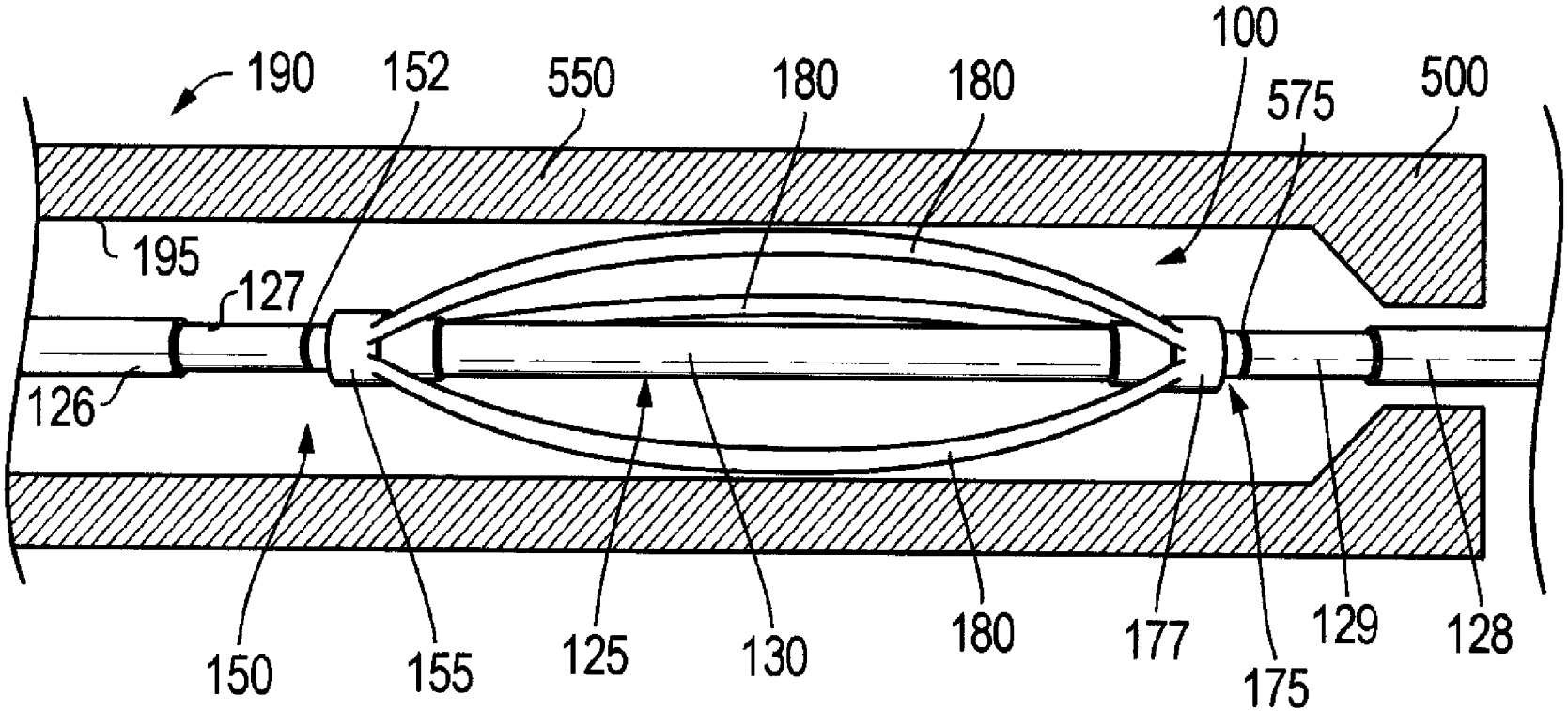
FIG. 5 is a partially cross-sectional view of the passive centralizer of FIG. 1 within a more downhole position of a borehole casing of the well.

Referring back to FIG. 1, the passive centralizer 100 also includes a locking site 175 where a locking mechanism is provided. The locking mechanism may include a compression collar 177 about the support body 125 and laterally mobile thereat. The compression collar 177 may be coupled to the arms 180, guiding their compressive and expansive or deploying movements. A retaining lock 575, as shown in FIG. 5, may also be provided as part of the locking mechanism to immobilize the compression collar 177 and eliminate expansive movement of the arms 180 once a predetermined degree of arm compression has occurred.

Continuing with reference to FIG. 1, other features of the passive centralizer may include an interior portion 130 of the support body 125 interiorly adjacent the arms 180 and other portions (126, 127, 128, 129) exterior thereto. In this regard, the support body 125 extends uphole of the interior portion 130 and traversing the deployment site 150 by way of a deployment support 127 and an uphole extension 126 which are detailed further below. Also detailed further herein are features of the support body 125 extending downhole of the interior portion 130 and traversing the locking site 175. These features are the locking support 129 and the downhole extension 128. Furthermore, a downhole sensor 140 may be provided on the passive centralizer 100 to collect information that may be employed in conjunction with the indicated deployment.

Figure 2:
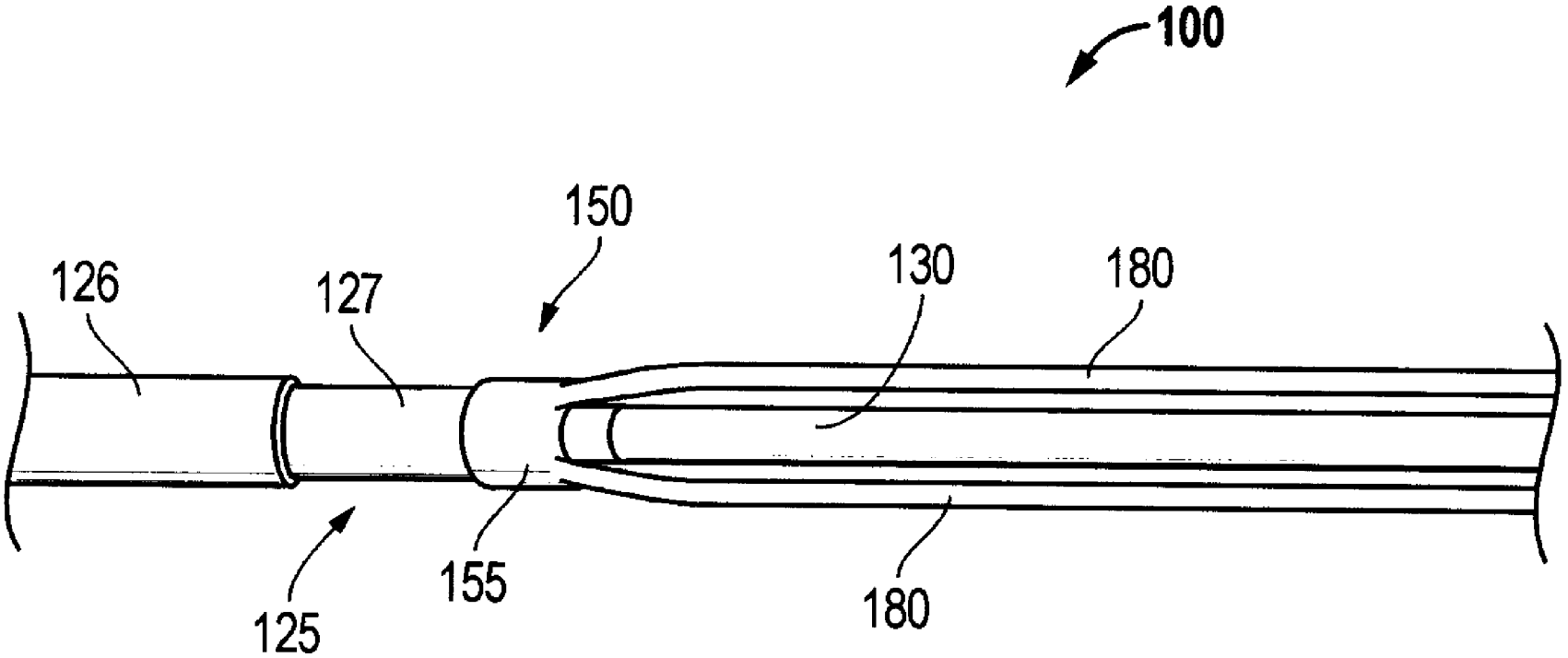
FIG. 2 is a side perspective view of the passive centralizer of FIG. 1 in a loaded position of stored energy.

Continuing now with reference to FIGS. 2 and 3, the passive centralizer 100 is depicted in a loaded position of stored energy prior to deployment of the arms 180 (the deployed position being shown in FIG. 1). As shown in FIGS. 2 and 3, in the loaded position, the arms 180 are retracted to a position adjacent to the interior portion 130 of the support body 125. In this retracted position, the arms 180 are flattened out from their natural bowed shaped and therefore contain stored energy.

As indicated above, the support body 125 extends uphole from the interior portion 130, traversing the deployment site 150. In order to achieve the loaded position, the deployment collar 155 is moved in a lateral uphole direction until it engages the retention implements 152. With one end of each arm 180 secured to the deployment collar 155 with a coupling pin 310, this lateral uphole movement of the deployment collar 155 over part of the deployment support 127 deforms and extends the arms 180 until they are pulled toward the interior portion 130 attaining a reduced or flattened profile. In the embodiment shown, the reduced profile includes the arms 180 substantially flat against the interior portion 130. As discussed above, this results in the arms carrying stored energy.

Note that in the processes of engaging the deployment collar 155 with the retention implements 152 to hold the arms 180 in the reduced profile or stored energy position, the deployment collar 155 may be forced toward the uphole extension 126 by manual or other conventional means until it traverses the retention implements 152. Once the retention implements 152 have engaged the deployment collar 155, as is shown in FIG. 3, the deployment collar 155 is immobilized and the arms 180 are locked in a "loaded" position of stored energy, ready for deployment and centralization at an operation site as shown in FIG. 1. As described further below, a disengagement of the retention implements 152 from the deployment collar 155 causes the stored energy to be released, allowing the arms 180 to automatically engage the well wall to centralize the support body 125.

Note that one end of the arms 180 is connected to the deployment collar 155 and another end of the arms 180 is connected to the locking collar 177. In one embodiment, the locking collar 177 is a unidirectional collar which may only be moved in the downhole direction. Thus, when the arms 180 are in the loaded position, the arms 180 tend to pull the locking collar 177 in the uphole direction. However, since the locking collar can only move in the downhole direction, the arms 180 are held in the loaded position until the deployment collar 155 is disengaged from the retention implements 152.

With reference to FIG. 3, an embodiment of securing the passive centralizer in the indicated loaded position is further detailed. In particular, FIG. 3 reveals a cross-sectional view of the retention mechanism with the deployment collar 155 pulled in an uphole direction away from the arms 180 and over the retention implements 152. Specifically, in the embodiment shown, the deployment collar 155 is equipped with protrusions 350 that snap securely over the retention implements 152 for immobilization of the deployment collar 155 as shown. As described below, this may be quite significant given the amount of energy stored in each bow spring arm 180 upon assuming the fully loaded position.

Each compressed arm 180 of embodiments described herein may be armed with between about 1,000 lbs. and about 4,000 lbs. per inch of compressed displacement. The total amount of this force may increase exponentially as the profile of the arm 180 is compressed further and further toward the interior portion 130 by the lateral movement of the deployment collar 155 as described above. For example, in one embodiment an arm 180 may display a deployed profile of expansion of up to about 7 inches at its highest point from the interior portion 130. Compression of this arm 180 down to a retracted position of about 0.5 inches at its highest point may provide the arm 180 with between about 2,000 lbs. and about 16,000 lbs. of force. This is a considerable amount of force that may be stored within each compressed arm 180, waiting to be released toward the well wall 195 when triggered into the centralizing position of FIG. 1.

In the embodiment depicted in FIG. 3, the retention implements 152 are raised teeth extending from deployment projections 300 circumferentially about this area of the deployment support 127. The deployment projections 300 are fingers supported by a retractable platform sleeve 375 that is of enough strength and stability to ensure the immobility of the retention implements 152 when they are secured to the deployment collar 155. In this manner, the retention implements 152 are capable of stably securing the deployment collar 155 in position in spite of the force exerted thereupon by the flattened bow spring arms 180 as described above. As shown in FIG. 3, this retention of the deployment collar 155 is achieved once a protrusion 350 thereof is advanced past the retention implements 152 in an uphole direction. (i.e. in a direction away from the arms 180). Once the deployment collar protrusions 350 are snapped over the retention implements 152 in this manner, the passive centralizer 100, and more specifically the arms 180 of the centralizer are "loaded" with stored energy.

With added reference to FIG. 1, the loaded centralizer 100 (as described with reference to FIGS. 2 and 3 above) is of a minimal profile adept at traversing a wide range of well diameter sizes, horizontal wells 190, highly deviated, tortuous, and other challenging well configurations. That is, the described "loading" of the passive centralizer 100 may be carried out prior to insertion of the passive centralizer 100 into a well 190. Therefore, in circumstances where the diameter of the well 190 is significantly larger than the profile of the centralizer 100 in its loaded position, the well wall 195 remains substantially undisturbed by contact with the arms 180 of the centralizer 100.

In such circumstances, forceful contact between the arms 180 and the well wall 195 may be avoided during advancement of the centralizer 100 to the operation site. Such forceful contact may be spared until deployment at the operation site where centralization is desired. This avoidance of unnecessary wall 195 contact and centralization in advance of the centralizer 100 reaching the operation site means that unnecessary shearing, scratching and other damage imposed on the wall 195 by the arms 180 may be minimized as well as wear on the arms 180 themselves. Therefore, in an embodiment such as that shown, the arms 180 may be of a particularly rugged configuration to endure downhole conditions without undue concern over damage to the wall 195 from the arms 180 throughout the advancement of the centralizer 180 to the operation site.

Figure 4:
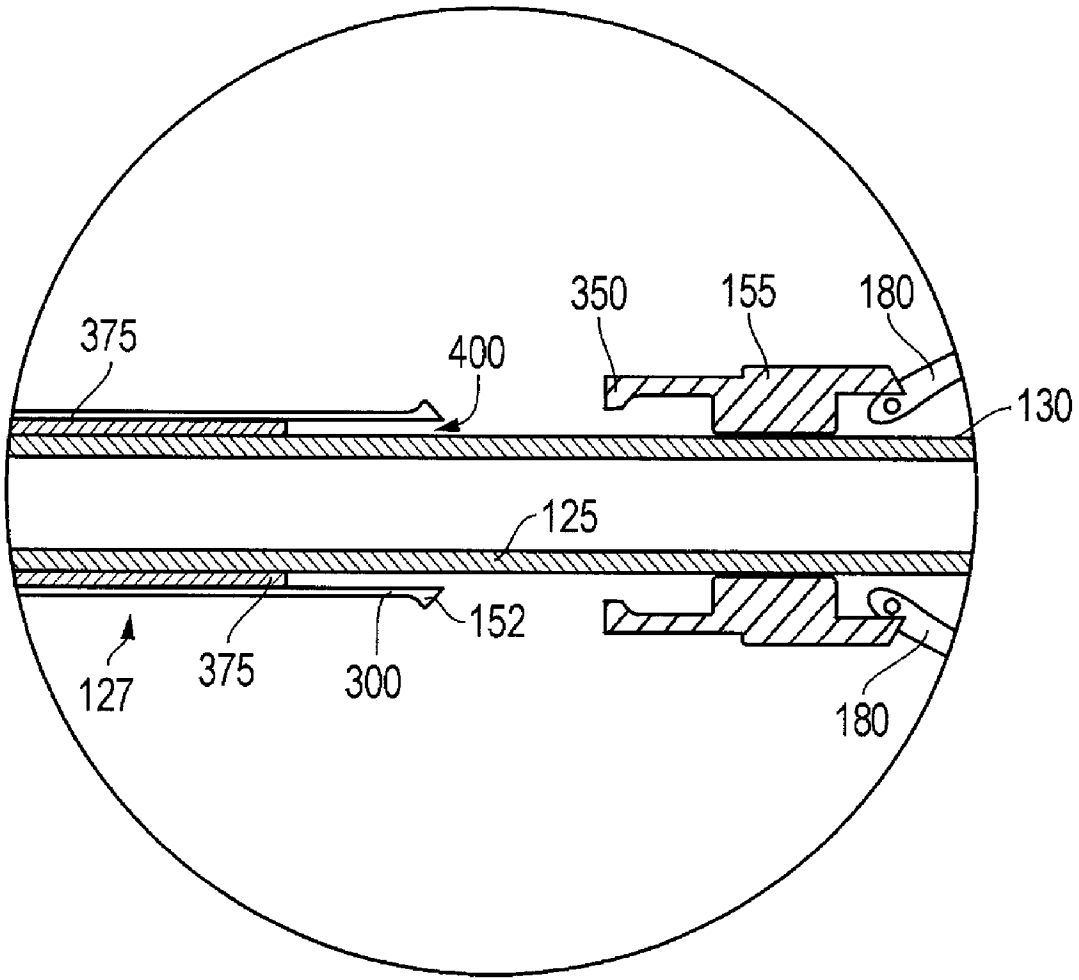
FIG. 4 is a side cross-sectional view of the retention and deployment mechanisms of FIGS. 2 and 3 following deployment from the loaded position.

Referring now to FIGS. 3 and 4 the passive centralizer may be advanced to an operation site as described above. As also indicated, the arms 180 of the passive centralizer 100 are loaded with a significant amount of stored energy when in the loaded position of FIG. 3. In fact, as alluded to above, the energy stored within the arms 180 in the loaded position is more than what may be retained by the deployment projections 300 and retention implements 152 acting alone. Thus, the retractable platform sleeve 375 is provided beneath the retention implements 152 to provide support thereto to ensure enough stability for retention of the deployment collar 155.

Referring now to FIG. 4, with added reference to FIG. 1, deployment of the passive centralizer 100 is described. Deployment may take place once the centralizer 100 is positioned within an operation site of the well 190, whereat the arms 180 may be radially deployed toward the well wall 195 for centering as shown and described with respect to FIG. 1. Additionally, the manner in which this deployment takes place may be automated and passive. Therefore, there may be no need for operator involvement specifically for actuating deployment of the arms 180.

Thus, the possibility of operator error may be minimized. Furthermore, as indicated below, the deployment may take place without any communication between the centralizer 100 and the well surface. This reflects the substantial elimination of the possibility of operator error for deployment as indicated. However, it also allows for the benefits of achieving deployment without any telemetry or other specialized, expensive, or sophisticated equipment devoted thereto.

Rather, as described below, the deployment may take place automatically upon detection by the centralizer 100 of certain downhole conditions.

Continuing with reference to FIGS. 1 and 4, automated passive deployment may be a function of downhole conditions in the well 190 as indicated. As depicted in FIG. 1, a downhole sensor 140 may be provided at the centralizer 100 to detect conditions within the well 190. For example, the downhole sensor 140 may be employed to detect pressure, temperature, the presence of particular corrosive materials, and other well characteristics. The centralizer 100 may thus be configured for deployment upon the detection of well conditions in line with the operation site as detected by the downhole sensor 140. That is, the centralizer 100 may be configured in light of a known profile of well characteristics from one location of the well 190 to another.

Once characteristics in line with the operation site are detected by the downhole sensor 140, this information may be employed by conventional means to actuate deployment of the arms 180. For example, in one embodiment, the operation site is known to have a pressure of between about 4,000 PSI and about 6,000 PSI. Therefore, the detection of 5,000 PSI by the downhole sensor 140 may lead to deployment of the arms 180 as described below. Indeed, the downhole sensor 140 itself may take the form of a conventional hydrostatic pressure release to trigger displacement of the platform sleeve 375. Similarly, the sensor 140 may take the form of a chemical release to spring displacement of the sleeve 375 upon corrosion thereto by the presence of a known corrosive at the operation site.

As noted above, it is the movement of the retractable platform sleeve 375, which may be moved by any appropriate means, which allows for the disengagement of the retention implements 152 from the deployment collar 155, which in turn allows for the deployment of the arms 180 into contact with the well wall to centralize the support body 125. That is, as shown in FIG. 4, when the retractable platform sleeve 375 is laterally displaced in an uphole direction with respect to the retention implements 152, voids 400 are created therebeneath. These voids 400 below the retention implements 152 cause the retention implements 152 to deflect inwardly toward the support body 125. That is, without the support of the sleeve 375, the force of the stored energy in the arms 180 in combination with the angled interface between the retention implements 152 and the deployment collar protrusions 350 is such that a deflection of the projections 300 takes place. This deflection results in a disengagement of the retention implements 152 from the deployment collar 155. As shown in FIG. 4, when the deployment collar 155 is disengaged from the retention implements 152, the deployment collar 155 and the arms 180 attached thereto spring into deployment to centralize the support body 125 as shown in FIG. 1.

The displacement of the retractable platform sleeve 375 as described above has allowed for a truly passive deployment of the arms 180 for centralization. In fact, the application of no more than between about 200 lbs. and about 275 lbs. of force may be more than enough to trigger the displacement of the retractable platform sleeve 375 by any appropriate means. This is in sharp contrast to the likely several thousand pounds of force released and maintained through each arm 180 of the centralizer 100 upon deployment thereof. Furthermore, the minimal trigger force supplied may be derived from stored energy released by the downhole sensor 140 itself. Thus, it is entirely possible to achieve deployment of the centralizer 100 without the addition of any energy once the centralizer 100 is lowered into the well 190.

According to the embodiment described above, complete centralization may also be achieved in a truly automated manner along with entirely passive deployment of centralizer arms 180. Furthermore, energy for biasing of the arms 180 against the well wall 195 is provided entirely by the arms 180 themselves as they attempt to reform to their inherent bow shape. Therefore, a centralized operation may take place without the requirement of operator input for the sake of maintaining deployment or centralization.

Figure 6:
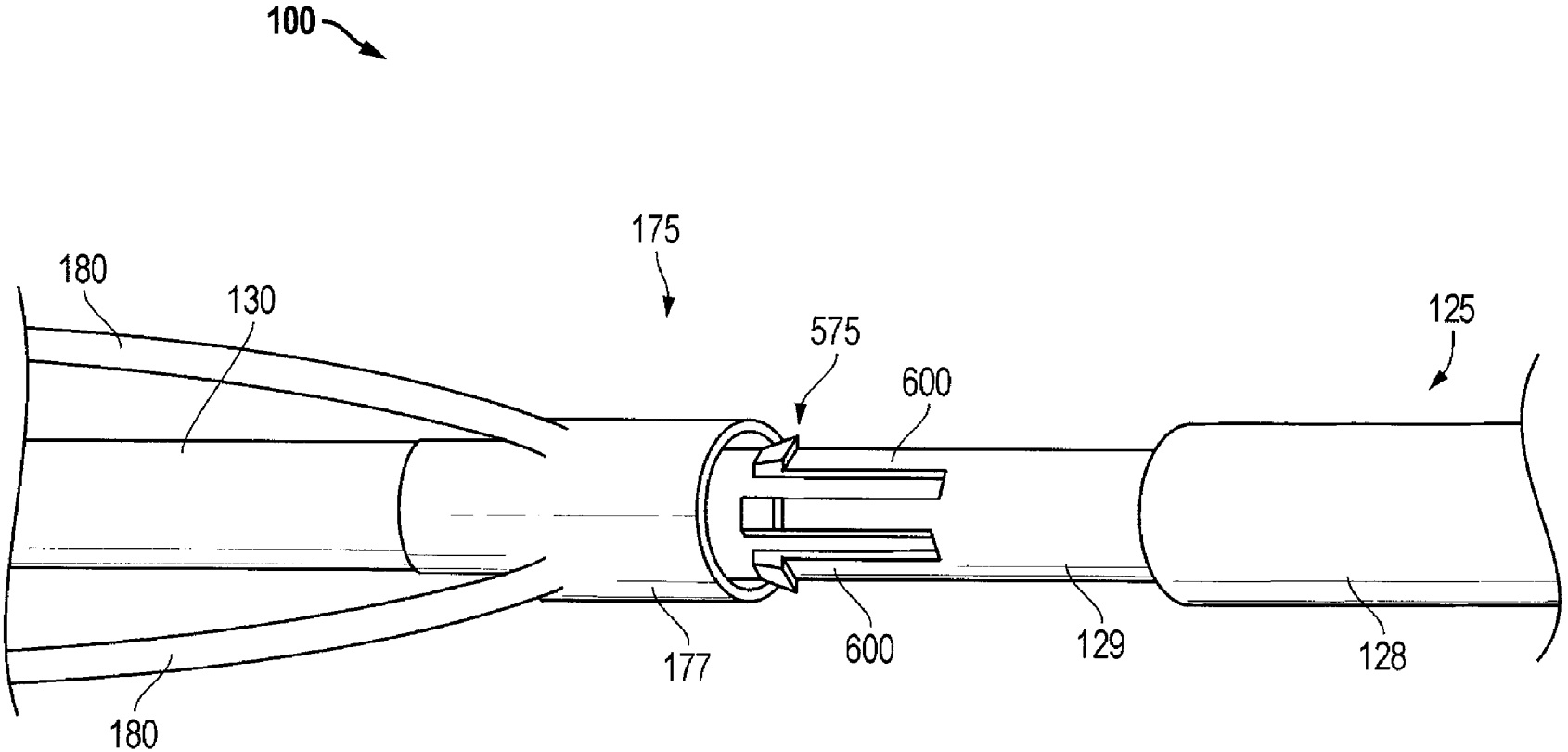
FIG. 6 is a side perspective view of a locking mechanism of the passive centralizer of FIG. 5.
Figure 7:
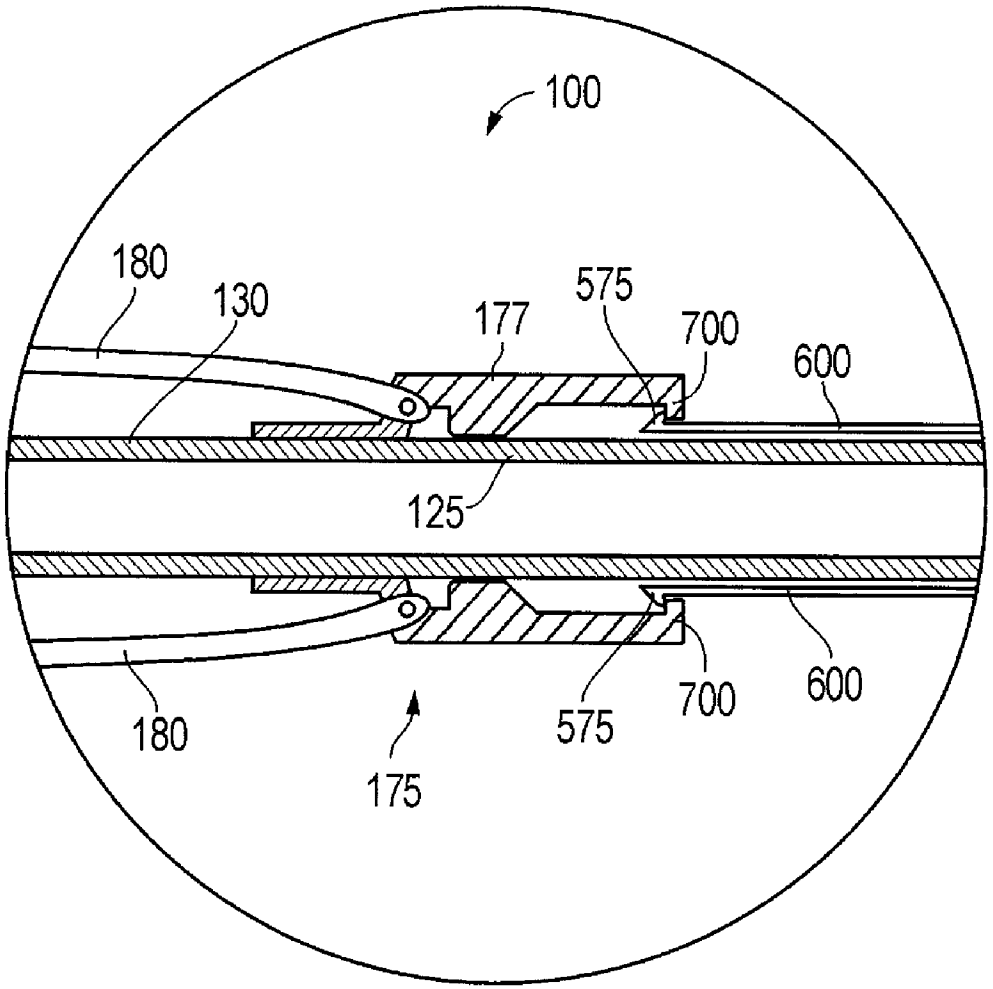
FIG. 7 is a side sectional view of the locking mechanism of FIG. 6 with the passive centralizer in a locked compressed position.

Referring now to FIGS. 5-7, following a centralized operation, the centralizer 100 may be advanced toward a known restriction 500 within the well 190 in order to force the deployed centralizer back into a compressed position. Again, for reasons described above, stable compression of the passive centralizer 100 may be advantageous for both protection of the well wall 195 and the centralizer 100 itself during non-centered conveyance thereof within a well 190. However, unlike the loaded position described above, the passive centralizer 100 shown in FIGS. 5-7 is being forced into a locked compressed position. That is, rather than "loading" the passive centralizer 100 with arms 180 to be deployed at an operation site, the arms 180 are to be retracted into a securely locked compressed position subsequent to employment at the operation site. As described below, this may be achieved by a locking mechanism found at the locking site 175 of the passive centralizer 100.

The above referenced locking mechanism includes a compression collar 177 about the support body 125 and laterally mobile thereat. The compression collar 177 is coupled to the arms 180 at one end thereof and slidable over a retaining lock 575 of the locking mechanism. As described further here, a sliding of the compression collar 177 over the retaining lock 575 in this manner may immobilize the compression collar 177, eliminating any further expansive movement of the arms 180. Stated another way, once a predetermined degree of arm compression has occurred, the centralizer 100 may be immobilized into a locked compressed position prohibiting any subsequent deployment.

With particular reference to FIG. 5, the portion of the well 190 depicted is lined with a borehole casing 550 that terminates at the noted restriction 500. This portion of the well 190 may be downhole of the operation site shown in FIG. 1 and of a smaller diameter. In the embodiment shown, the restriction 500 may be a conventional nipple feature, generally about 3-4 inches in diameter and found near the terminal end of a well 190 and serving other well functions. Nevertheless, the nipple restriction 500 may be employed to effectuate a locked compressed position of the passive centralizer 100 as described here. Other restriction types may similarly be employed that are commonly found within wells such as appropriately sized production tubing, crossovers, valves, and mandrels. Additionally, a variety of other restriction types may be employed that are positioned in the well 190 primarily for the purpose of effectuating the locked compressed position.

Continuing with reference to FIG. 5, the deployment site 150 is shown with the deployment collar 155 disengaged from the retention implements 152. However, the diameter of the borehole casing 550 may be less than that at the operation site shown in FIG. 1. For example, the diameter at the operation site may have been between about 6 inches and about 12 inches, whereas the portion of the borehole casing 550 shown may have a diameter of between about 3 inches and about 5 inches. Therefore, additional force is exerted on the arms 180 and the well wall 195. This has the potential to lead to shearing and other wear on the well wall 195 and the arms 180 as the passive centralizer 100 is advanced or retracted within the well 190. Therefore, the restriction 500 may be employed to force the centralizer 100 into a locked compressed position with arms 180 substantially flattened along the interior portion 130 of the support body 125. In the embodiment shown, the restriction 500 may be less than about 3 inches in diameter in order to achieve the degree of compression necessary to force the centralizer 100 into the locked compressed position.

Continuing now with reference to FIGS. 5 and 6, the deployment collar 155 is disengaged from the retention implements 152 in deploying the arms 180 as described above. However, in the embodiment shown, as the centralizer 100 passes through the narrowing well 190 and ultimately the restriction 500, it is the movement at the locking site 175 that is now of note. That is, with the narrowing of the well 190, the diameter thereof and any tool therein become more closely matched. Thus, centralization becomes of negligible concern and a locking mechanism begins to come into play as the compression collar 177 moves toward the retaining lock 575. In fact, forcing the centralizer 100 through the even narrower restriction 500 may be enough to force the compression collar 177 into a locking engagement with the retaining lock 575 leaving the arms 180 immobilized in the locked compressed position. Note in one embodiment, after the loaded position has been obtained, the deployment collar 155 is prevented from moving in the uphole direction. Thus when the locking collar 177 is engaged with the retaining lock 575, the arms 180 tend to push the deployment collar 155 in the uphole direction. However, since the deployment collar 155 is prevented from moving in the uphole direction, the arms 180 are held in the compressed position.

As detailed in FIGS. 6 and 7, the retaining lock 575 may be teeth supported by a series of locking projections 600 at the locking support 129 portion of the support body 125. Once retaining projections 700 of the compression collar 177 are forced across teeth of the retaining lock 575, the arms 180 may be immobilized into a locked compressed position. That is, as depicted in FIG. 7, with the retaining projections 700 employing an angle of at least about 90° to interface the teeth of the retaining lock 575, uphole movement of the compression collar 177 may no longer be possible.

As described above, deployment or expansion of the arms 180 away from the interior portion 130 of the support body 125 is eliminated once the compression collar 177 has been forced far enough in a laterally downhole direction (i.e. by a predetermined degree of arm compression). This manner of locking the arms 180 down into a compressed position is achieved through centralizer advancement in an automated manner. That is, the dimensions and locations of the compression collar 177, the retaining lock 575, and the restriction 500 itself are determinative of the degree of compression required by the arms 180 in order to achieve the locked compressed position. Operator involvement, and thus operator error, is eliminated as a factor in achieving such a stable compression of the centralizer 100. Furthermore, once locked in this manner, the possibility of redeployment of the centralizer 100 within the well 190 is eliminated.

With added reference to FIG. 3, the above described compressing of the arms 180 into a locked compressed position is achieved with a locking mechanism of the compression collar 177 interacting with a retaining lock 575 at the locking site 175. This is done in lieu of re-engagement of the deployment collar 155 to the retention implements 152 (i.e. to re-attain the loaded position as detailed above). That is, with the displacement of the retractable platform sleeve 375 for deployment, re-engagement of the deployment collar 155 to the retention implements 152 may no longer be an option for effectuating a stable compressed position of the arms 180. In the embodiment described above, this configuration may be employed to ensure a single deployment of the centralizer 100 per run through the well 190. However, in an alternate embodiment, the platform sleeve 375 may be temporarily displaced with a piston-like motion for the sake of deployment. In such an embodiment the immediate return of the platform sleeve 375 to its original position upon deployment allows for the noted re-engagement of the deployment collar 155 to the retention implements 152. Therefore, rather than employing a locking mechanism, in an alternate embodiment the centralizer 100 may be reloaded for multiple deployments during a run through the well 190.

Embodiments described hereinabove employ a passive centralizer to limit damage to the wall of a well as well as the centralizer itself during advancement within the well due to the compressed positions attainable by the centralizer throughout its time within the well. That is, the centralizer may be deployed primarily during centralization at an operation site rather than throughout the entirety of its time within the well. Furthermore, the automated and passive responsiveness of the profile of the centralizer based on downhole conditions and restrictions minimizes the possibility of operator error resulting from a centralizing application. The passive nature of the centralizer also eliminates the need for powering arms of the centralizer throughout the duration of a centralizing application. Thus, error in active power delivery to the arms is also eliminated as a concern.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. For example, the triggering of deployment for embodiments described above is achieved in an automated manner based on the detection of particular downhole conditions. However, in alternate embodiments, the triggering of deployment may take place based on actuation from the surface, outside of the well. As such, the foregoing description should not be read as pertaining only to the precise structures described and shown in the accompanying drawings, but rather should be read as consistent with and as support for the following claims, which are to have their fullest and fairest scope.

We claim:

1. A passive centralizer for centralizing a tool within a well wall, the centralizer comprising:

a support body;

an arm coupled to said support body;

a retention mechanism comprising:

a deployment collar laterally mobile about said support body and coupled to said arm, and a retention implement coupled to said support body for immobilizing said deployment collar to retain said arm in a loaded position of stored energy adjacent said support body; and a deployment mechanism coupled to said retention mechanism and moveable to disengage at least a portion of the retention mechanism from the arm to allow for a radial expansion of the arm away from said support body and into contact with the well wall, wherein said retention implement comprises deflectable deployment projections having raised teeth to interface said deployment collar for the immobilizing, and wherein a deflection of the deployment projections allows for said disengagement of at least a portion of the retention mechanism from the arm to allow for said radial expansion of the arm, wherein said deployment mechanism comprises a retractable platform sleeve to support said deflectable deployment projections, and wherein a movement of the retractable platform sleeve allows for said deflection of the projections.

2. The passive centralizer of claim 1 wherein the loaded position comprises said arm pulled to a reduced profile toward said support body to enhance advancement of the passive centralizer within a well.

3. The passive centralizer of claim 1 wherein the arm automatically moves from said position adjacent to the support body to said radial expansion upon said disengagement of at least a portion of the retention mechanism from the arm due to a release of the stored energy.

4. The passive centralizer of claim 3 wherein the stored energy is up to about 4,000 pounds inch.

5. The passive centralizer of claim 4 wherein said arm comprises a profile in a natural unloaded position that is up to about 7 inches, wherein said arm comprises a profile in the loaded position that is down to about 0.5 inches, and wherein the force held by the stored energy is between about 2,000 pounds and about 16,000 pounds.

6. The passive centralizer of claim 1 wherein said arm comprises one of a bow spring, a spring loaded projectable linkage, and a combination of a bow spring and a spring loaded projectable linkage.

7. The passive centralizer of claim 1 further comprising a downhole sensor coupled to said deployment mechanism for detecting a condition within a well and effectuating said movement of the retractable platform sleeve which allows for said deflection of the projections.

8. The passive centralizer of claim 7, wherein said condition is a predetermined temperature.

9. The passive centralizer of claim 7, wherein said condition is the presence of a material of a predetermined corrosiveness.

10. A passive centralizer for centralizing a tool within a well wall, the centralizer comprising:

a support body;

an arm coupled to said support body and moveable from a retracted position to a radially expanded position to contact the well wall;

a collar coupled to the arm and moveable about the support body;

a locking device engaged with the collar to releasably retain the arm in the retracted position; and wherein a movement of a sleeve relative to the support body and the collar causes the locking device to disengage from the collar, enabling the arm to move from the retracted position to the radially expanded position.

11. The passive centralizer of claim 10 wherein the arm is a bow spring.

12. The passive centralizer of claim 10 wherein said movement of the sleeve causes the locking device to deflect radially inwardly relative to the support body, causing a disengagement of the locking device from the collar.

13. The passive centralizer of claim 10, wherein said movement of the sleeve causes a deflection of the locking device, this deflection causing the locking device to disengage from the collar.

14. The passive centralizer of claim 10, further comprising a sensor for detecting a condition within a well and effectuating said movement of the sleeve, wherein said condition is a predetermined temperature.

15. The passive centralizer of claim 10, further comprising a sensor for detecting a condition within a well and effectuating said movement of the sleeve, wherein said condition is the presence of a material of a predetermined corrosiveness.

16. The passive centralizer of claim 10, further comprising second locking collar for holding the arm in a second retracted position upon a predetermined radially inward movement of the arms from the radially expanded position.

17. The passive centralizer of claim 16, wherein the predetermined radially inward movement of the arms is caused by passing the arms over a restriction in the well.

18. The passive centralizer of claim 17, wherein the restriction is a nipple, a crossover, a valve, a mandrel or a small production tubing.

* * * * *